US005609074A

United States Patent [19]

Venaas

[11] Patent Number: 5,609,074

[45] Date of Patent: Mar. 11, 1997

[54] UNIDIRECTIONAL REGISTER FOR ELECTRICITY METER

[75] Inventor: Norman B. Venaas, Seneca, S.C.

[73] Assignee: Schlumberger Industries, Inc., Norcross, Ga.

[21] Appl. No.: 385,488

[22] Filed: Feb. 8, 1995

[51] Int. Cl.[6] ..... G06M 1/00

[52] U.S. Cl. ..... 74/810.1; 475/12

[58] Field of Search ..... 74/810.1; 475/12, 475/13

[56] References Cited

U.S. PATENT DOCUMENTS

| | | | |
|---|---|---|---|
| 2,587,038 | 8/1946 | Goodell | 74/810.1 X |
| 3,981,439 | 9/1976 | Ham | 74/810.1 X |
| 4,164,647 | 8/1979 | Ham | 235/91 |
| 4,177,922 | 12/1979 | Hart et al. | 235/144 MA |
| 4,352,979 | 10/1982 | Knecht | 74/810.1 X |
| 4,365,194 | 12/1982 | Halstead et al. | 324/116 |
| 4,559,494 | 12/1985 | Takeshita | 324/103 R |
| 4,762,434 | 8/1988 | Hirano | 74/810.1 X |

*Primary Examiner*—Charles A. Marmor
*Assistant Examiner*—Saul Rodriguez
*Attorney, Agent, or Firm*—Leonard W. Pojunas

[57] ABSTRACT

A unidirectional register apparatus includes an input gear mechanism adapted to receive a rotational input from an external source; and a yoke, operatively coupled to the input gear mechanism, and arranged to pivot between a first predetermined position and a second predetermined position in response to a change in direction of the rotational input. Also provided are a first gear mechanism, attached to the yoke, which is arranged to produce a rotational output in the same direction as the rotational input; and a second gear mechanism, also attached to the yoke, which is arranged to produce a rotational output in a direction opposite to the rotational input. An output gear mechanism is provided which is alternately engageable with each of the first and second gear mechanisms. The output gear mechanism engages the first gear mechanism when the yoke is in the first predetermined position, and the output gear mechanism engages the second gear mechanism when the yoke is in the second predetermined position.

20 Claims, 7 Drawing Sheets

UNIDIRECTIONAL REGISTER FOR ELECTRICITY METER

BACKGROUND OF THE INVENTION

1. Field of the Invention

This invention relates to a dial register apparatus of the kind typically used as an electricity watthour meter, and, more specifically, to a unidirectional register apparatus in which a mechanical register dial is driven in a single, upscale direction regardless of which direction, forward or reverse, a input gear assembly is driven.

2. Description of the Related Art

Dial registers of the type shown in FIG. 1 have been used to measure and record the consumption of utilities, such as water, gas, or electricity. The dial register assembly 100 illustrated in FIG. 1 includes a front plate 104, fastened to a back plate (not shown in FIG. 1) by means of spacer studs 102, with dial indicators 106 sweeping across (in a forward, upscale direction) dials 108 to record the consumption of, for example, kilowatt hours of electricity. Typically, the rightmost dial 108 (as viewed in FIG. 1) would display the "ones" value of kilowatt usage, the dial 108 to its immediate left would display the "tens" value of kilowatt usage, the dial 108 to its immediate left would display the "hundreds" value of kilowatt usage, and so on.

Among the various types of dial registers is the "unidirectional register," in which the dial indicators move only in a single, upscale direction regardless of which direction, forward or reverse, an input gear mechanism is driven. Unidirectional registers were originally developed to prevent attempts to defraud the utility companies by such actions which might cause the meters to register an improperly low rate of consumption. For example, in a bi-directional register, a consumer could simply rotate the input gear mechanism in a direction opposite that in which the input gear mechanism would normally rotate to register consumption. This will cause the bi-directional register to rotate in its reverse direction, causing the dial indicators to run downscale rather than upscale, thus decreasing the amount of power registered. To prevent such misuse of registers, and a consequent economic loss to utility companies, unidirectional registers were developed in which the register dial indicators always rotate in an upscale direction regardless of the forward or reverse direction of rotation of the input gear drive assembly.

An example of a unidirectional register is illustrated in FIGS. 2–4. As shown therein, the unidirectional register mechanism includes a reversing yoke 200 having two drive pinions 202 and 204 disposed thereon. The yoke 200 is coaxially aligned with a compound staff/gear 214, both of which rotate about an axle 222 (see FIG. 4). The compound staff/gear is engaged with an input gear 212, which receives a rotational input from an external source (not shown) which corresponds to the consumption of the utility being registered.

An idler gear (or reversing gear) 206 remains engaged at all times with an intermediate gear 208, which in turn engages a first recording gear 210. The unidirectional register mechanism is sandwiched between a front plate 218 and a rear plate 220 (see FIG. 4). The axle 222 is fitted through holes formed in the front plate 218 and the back plate 220.

FIG. 2 shows the input gear 212 being rotated in a forward (clockwise) direction. As a result, the compound staff/gear 214 rotates about the axle 222 in a reverse (counter-clockwise) direction. The friction present between the compound staff/gear 214 and the yoke 200 causes the yoke 200 to rotate about the axle 222 in the reverse direction until stopped by a stop member 216 which is used both to limit the travel of the yoke 200 and to limit the engagement of the pinion 204 with the intermediate gear 208. When the pinion 204 is in engagement with the intermediate gear 208, the intermediate gear 208 will be driven in the reverse direction, and the intermediate gear 208 will, in turn, drive the first recording gear 210 in the forward direction. The forward rotation of the first recording gear 210 causes the corresponding register dial indicator 106 (see FIG. 1) to move upscale across the dial face 108, thereby registering power consumption.

FIG. 3 shows the input gear 212 being driven in the reverse direction. As a result, the compound staff/gear 214 rotates in the forward direction. The friction present between the compound staff/gear 214 and the yoke 200 causes the yoke 200 also to rotate about the axle 222 in the forward direction until pinion 202 is brought into engagement with the idler gear 206, which, in turn, is caused to rotate in the forward direction. The idler gear 206, which is permanently engaged with the intermediate gear 208, drives the intermediate gear 208 in the reverse direction, thus driving the first recording gear 210 in the forward direction. As with the state of the register mechanism illustrated in FIG. 2, the forward rotation of the first recording gear 210 causes the corresponding register dial indicator 106 (see FIG. 1) to move upscale across the dial face 108, thereby registering power consumption.

In the above-described manner, the dial register is always driven upscale regardless of which direction, forward or reverse, the input gear 212 is driven.

However, in the state of the register mechanism illustrated in FIG. 2, the idler gear 206 is essentially superfluous, and may in fact cause inaccuracies in the recording of power consumption. That is, even though the intermediate gear 208 is being driven exclusively by the pinion 204 in the state shown in FIG. 2, the intermediate gear 208 remains engaged with the idler gear 206, thereby driving the idler gear 206 in the forward direction. In contrast, in the state of the mechanism illustrated in FIG. 3, in which the intermediate gear 208 is driven exclusively by the idler gear 206 (via pinion 202), the intermediate gear 208 is not in engagement with the unused pinion 204.

Because of the differences between these two states, when the register is in the state shown in FIG. 2 (i.e., input gear 212 is rotating in the forward direction), the intermediate gear 208 is subject to an unnecessary resistance equal to an amount of force required to rotate the idler gear 206 in the forward direction. In contrast, when the register is in the state shown in FIG. 3 (i.e., the input gear 212 is rotating in the reverse direction) the intermediate gear 208 is not subject to any unnecessary resistance because the unused drive gear (i.e., pinion 204) has been disengaged from the intermediate gear 208. As a result of the difference in resistive force, the register mechanism may record power consumption at different rates depending on which direction the input gear 212 is driven. In this manner, the reliability of the register mechanism is reduced because inaccuracies in the recording of power consumption may result. In addition, the configuration of the conventional unidirectional register illustrated in FIGS. 2–4 causes the overall device to be larger and more costly to manufacture.

SUMMARY OF THE INVENTION

One object of the present invention is to provide a unidirectional register mechanism having improved accuracy, functionality, and reliability as well as increased compactness and reduced manufacturing costs.

Another object of the present invention is provide a unidirectional register mechanism in which only a single pinion that is actively driving an output gear is in engagement with the output gear.

Another object of the present invention is to provide a unidirectional register mechanism in which the drive gears that compensate for a change in the direction of a rotational input are connected to a yoke structure, which yoke structure pivots between two different positions in response to a change in direction of the rotational input.

Still another object of the present invention is to provide a unidirectional register mechanism in which a reversing pinion is connected to the yoke structure and travels (or, pivots in concert) with the yoke structure when it pivots in response to a change in direction of the rotational input.

Yet another object of the present invention is to provide a unidirectional register mechanism in which a yoke structure pivots in response to a change in direction of the rotational input to alternately apply a single one of two pinions to an output gear, wherein one pinion is rotating in the same direction as the rotational input and the other pinion is rotating in a direction opposite to the direction of the rotational input, thereby driving the output gear in a single, upscale direction.

In one embodiment, the foregoing and other objects are achieved by a unidirectional register apparatus that includes an input gear mechanism which receives a rotational input from an external source; a yoke, operatively coupled to the input gear mechanism, and arranged to pivot between a first predetermined position and a second predetermined position in response to a change in direction of the rotational input; a first gear mechanism, attached to the yoke, and arranged to produce a rotational output in a same direction as a rotational input direction; a second gear mechanism, attached to the yoke, and arranged to produce a rotational output in an opposite direction as the rotational input direction; and an output gear mechanism, alternately engageable with each of the first and second gear mechanisms, wherein (i) the output gear mechanism engages the first gear mechanism when the yoke is in the first predetermined position, and (ii) the output gear mechanism engages the second gear mechanism when the yoke is in the second predetermined position.

In another embodiment of the present invention, the foregoing and other objects are achieved by a unidirectional register apparatus that includes a yoke, operatively coupled to a rotational input from an external source, and pivotally mounted to alternately adopt (i) a first predetermined position when the rotational input comprises forward rotation, and (ii) a second predetermined position when the rotational input comprises reverse rotation; a first gear mechanism, attached to the yoke, and arranged to produce a rotational output in a same direction as a rotational input direction; a second gear mechanism, attached to the yoke, and arranged to produce a rotational output in an opposite direction as the rotational input direction; and an output gear, alternately engageable with each of the first and second gear mechanisms, wherein (i) the output gear engages the first gear mechanism when the yoke is in the first predetermined position, and (ii) the output gear engages the second gear mechanism when the yoke is in the second predetermined position.

These and other features of the present invention will become evident from the detailed description set forth hereafter with reference to the accompanying drawings.

DETAILED DESCRIPTION OF THE PREFERRED EMBODIMENT

Figure 1:
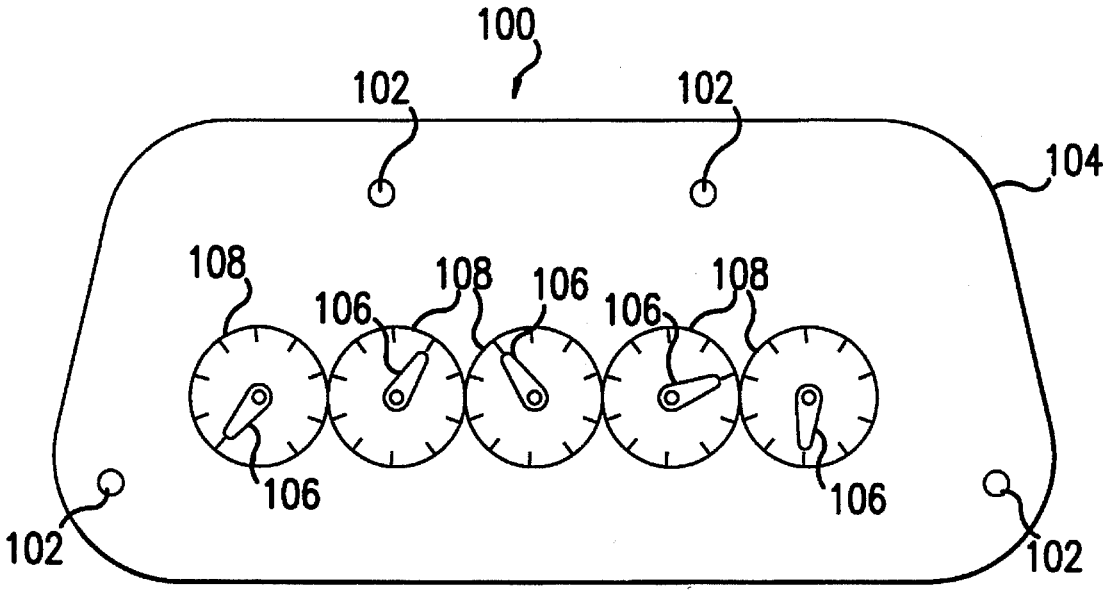
FIG. 1 is a front plan view of a front plate of a register apparatus of the kind typically used as an electricity meter.
Figure 2:
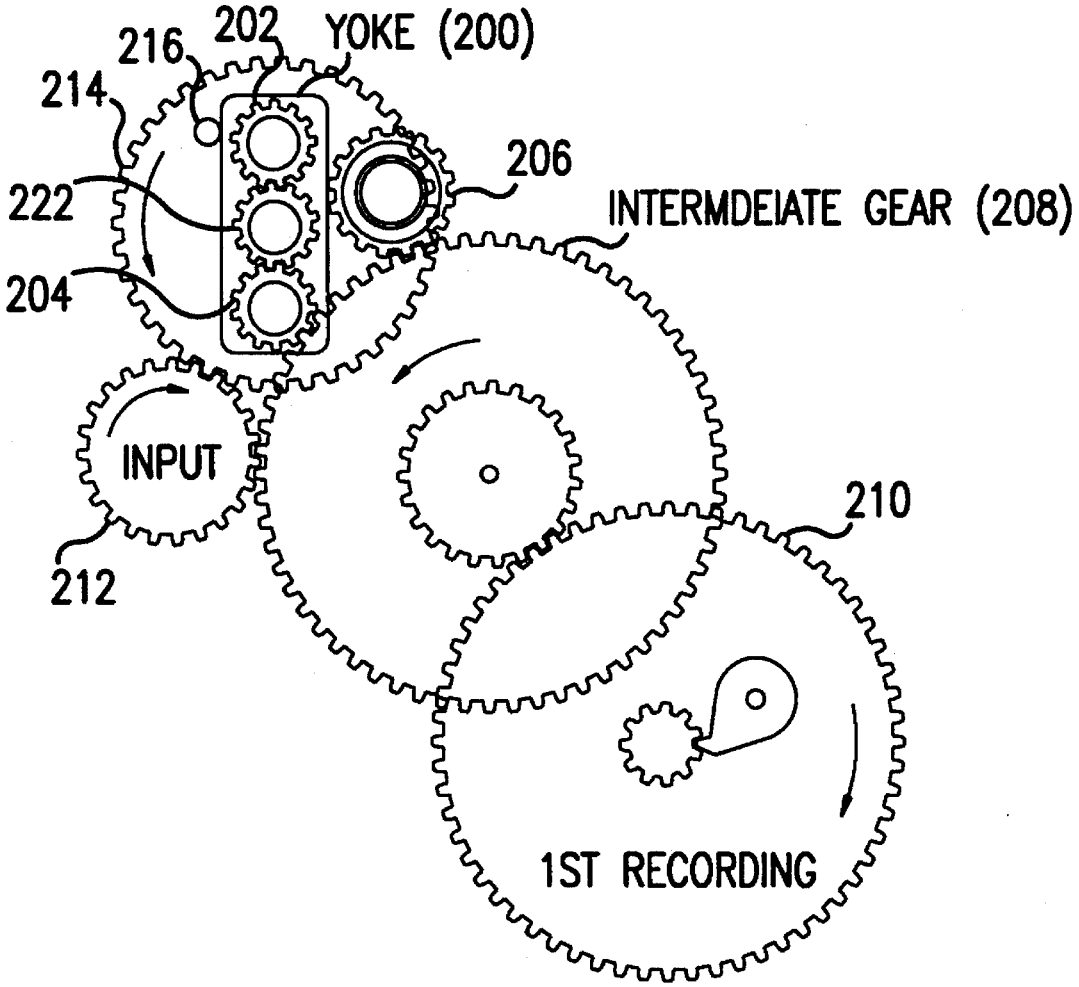
FIG. 2 is a partial plan view of a conventional unidirectional register mechanism.
Figure 3:
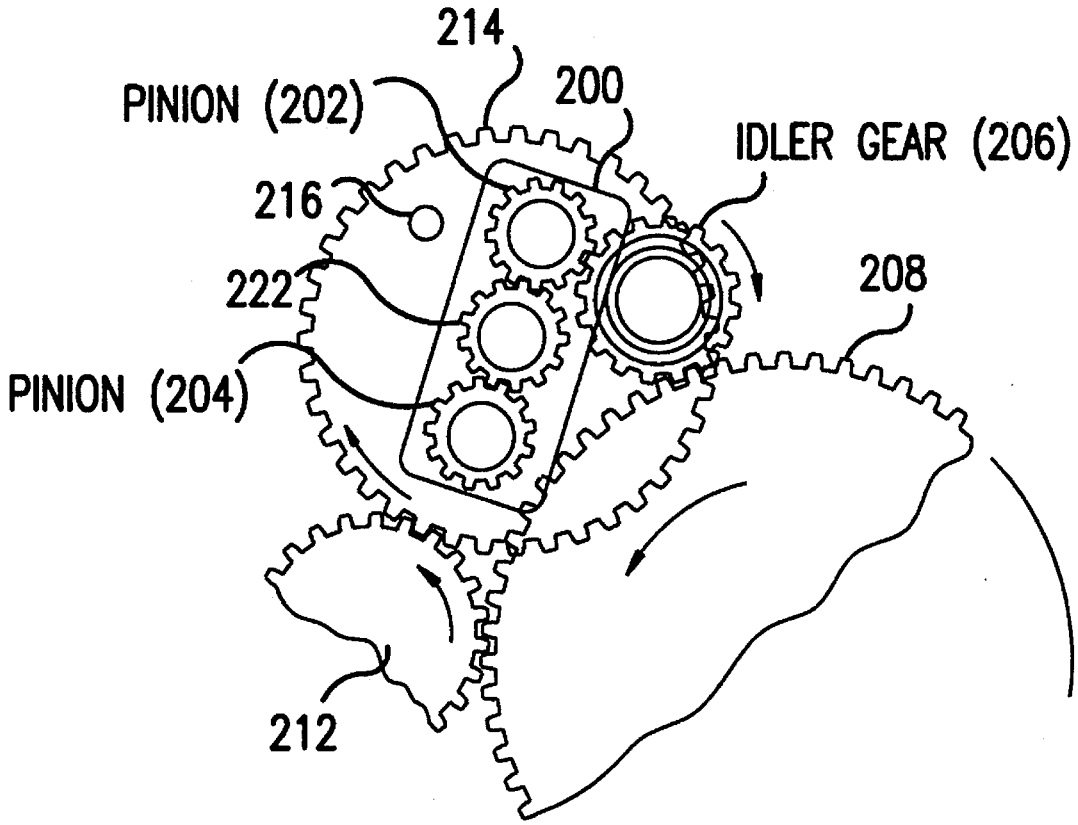
FIG. 3 is an enlarged plan view of the conventional unidirectional register mechanism illustrated in FIG. 2.
Figure 4:
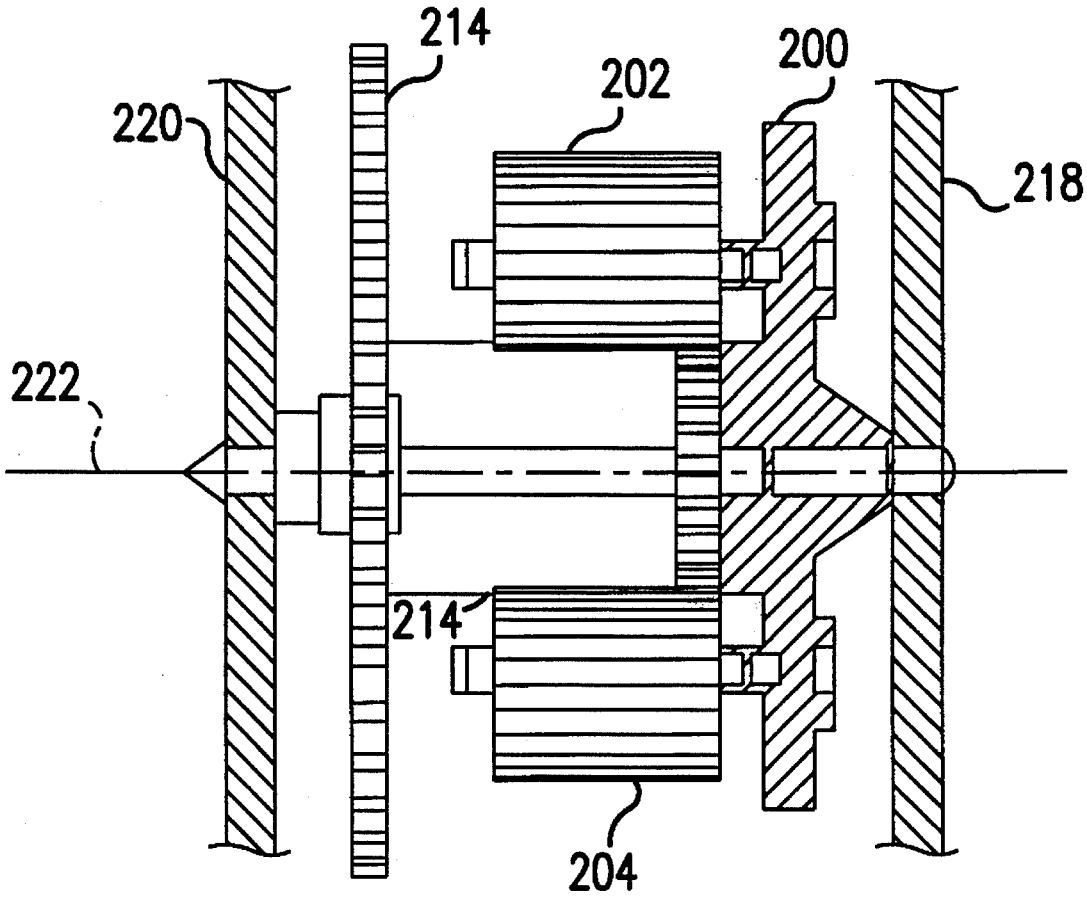
FIG. 4 is a side view of the conventional unidirectional register mechanism illustrated in FIG. 3.

A detailed description of a unidirectional register apparatus according to an embodiment of the present invention is set forth below with reference to the FIGS. 5–7.

As shown therein, the unidirectional register apparatus includes an input gear 512, which receives the rotational input from an external source (not shown) which corresponds to the consumption of the utility being registered. The input gear 512 engages and drives a compound staff/gear 514. A yoke 500 is coaxially aligned with the compound staff/gear 514. Both the compound staff/gear 514 and the yoke 500 rotate about an axle 522 (see FIG. 7). The yoke 500 has three pinions disposed thereon—a first drive pinion 504, a reversing pinion 506, and a second drive pinion 502—each of which is rotatably attached to the yoke 500. The compound staff/gear 514 is engaged with, and drives, both the first drive pinion 504 and the reversing pinion 506. The reversing pinion 506 is engaged with, and drives, the second drive pinion 502.

Depending on the direction of rotation of the input gear 512, discussed in more detail below, one of the first drive pinion 504 and the second drive pinions 502 will be placed into engagement with an intermediate gear 508, which in turn engages and drives a first recording gear 510.

Figure 7:
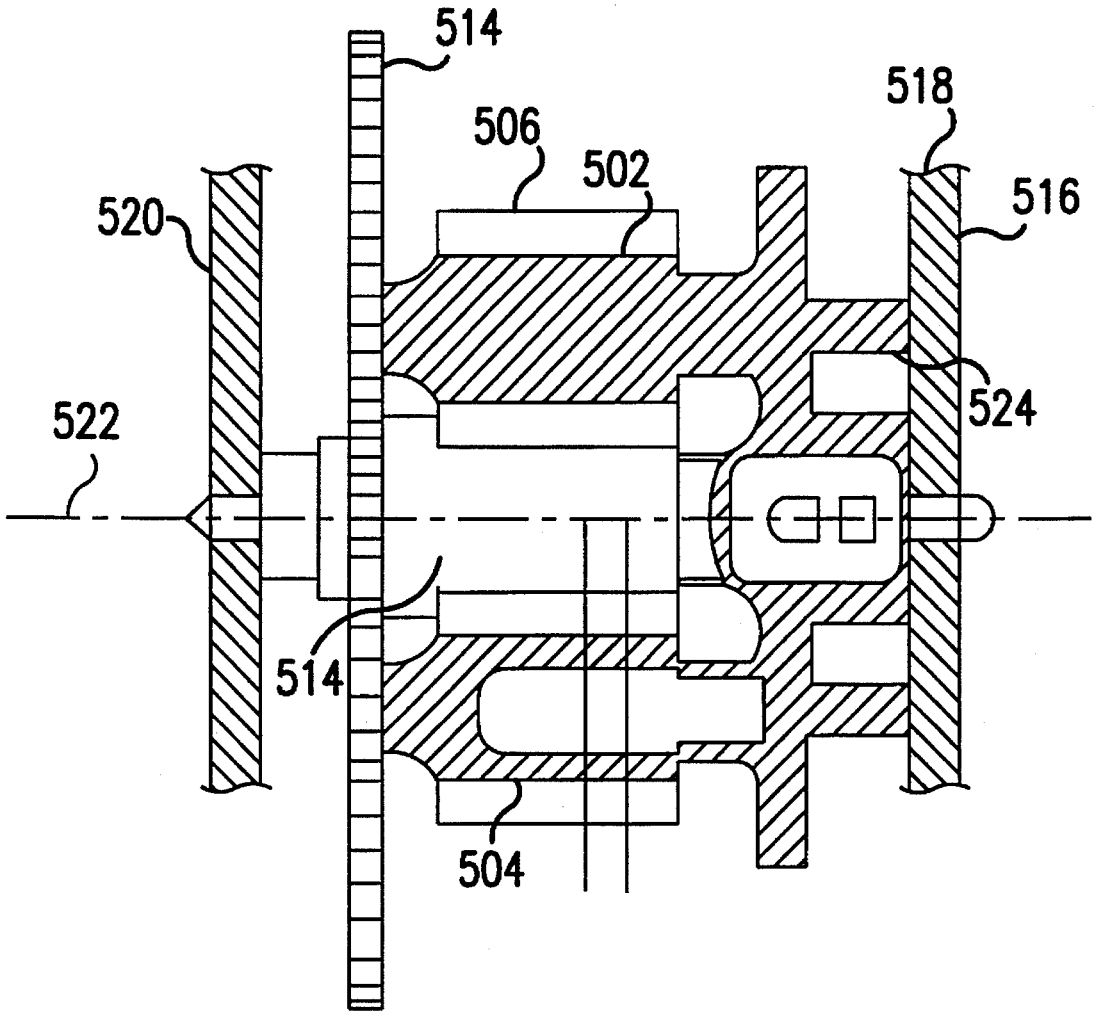
FIG. 7 is a side view of the embodiment of the unidirectional register mechanism illustrated in FIG. 6.

The unidirectional register mechanism is sandwiched between a front plate 518 and a rear plate 520 (see FIG. 7). The axle 522 is fitted through holes formed in the front plate 518 and the back plate 520. Attached to the yoke 500 is a stop member 516, which fits through a hole 524 formed in the front plate 518. The hole 524 is formed to be larger than the stop member 516 so that there is a sufficient amount of play to allow the yoke 500 to pivot between the following two predetermined positions in response to a change in direction of the input gear 512: (i) a first position in which the first drive pinion 504 engages and drives the intermediate gear 508, and (ii) a second position in which the second drive pinion 502 engages and drives the intermediate gear 508. Each of the three pinions 502, 504, and 506 travels with the yoke 500 as it pivots between the first and second positions.

Figure 5:
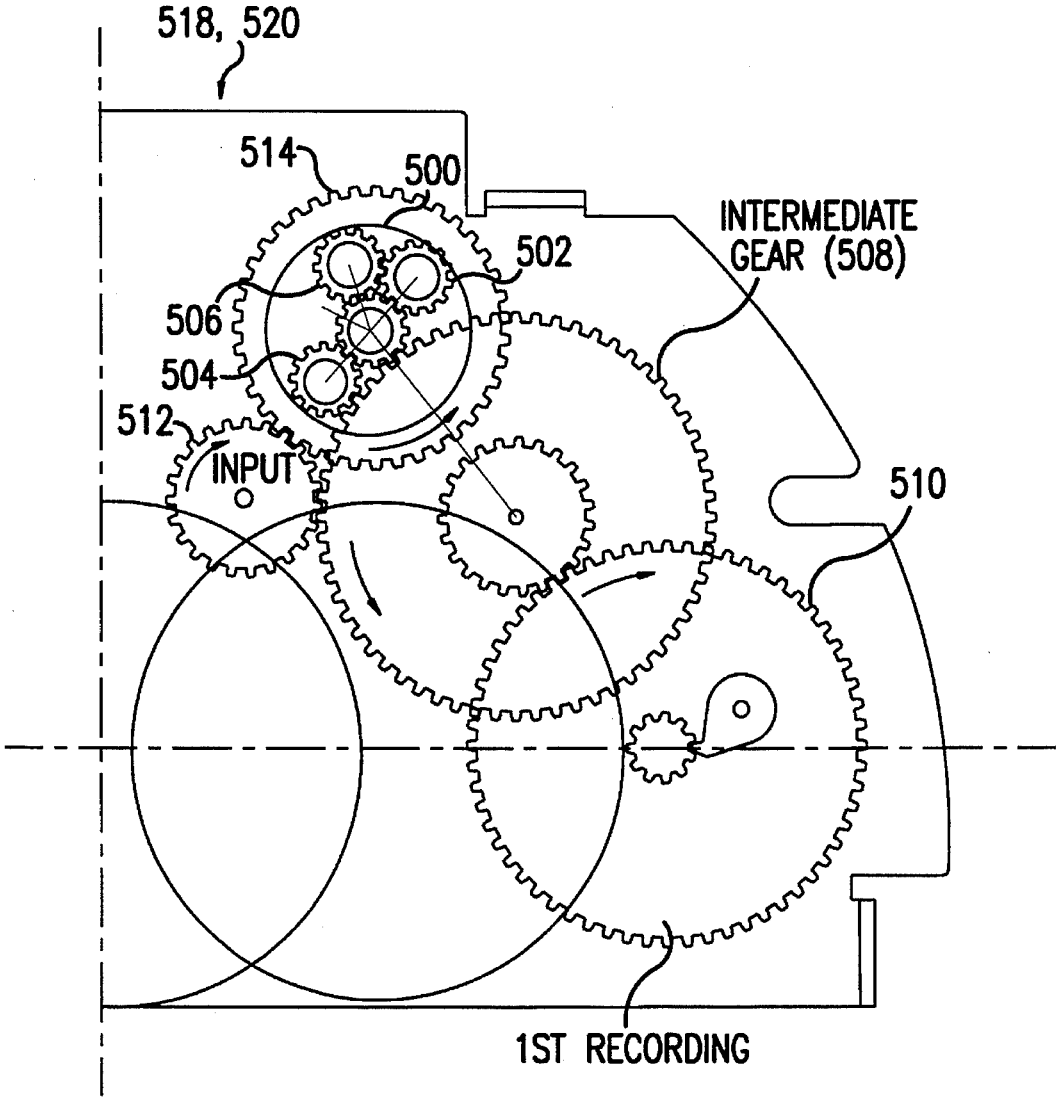
FIG. 5 is a partial plan view of a unidirectional register mechanism according to an embodiment of the present invention.

As shown in FIG. 5, when the rotational input from the external source causes the input gear 512 to rotate in a forward (clockwise) direction, the compound staff/gear 514 is caused to rotate about axle 522 in a reverse (counterclockwise) direction. Friction present between the compound staff/gear 514 and the yoke 500 induces the yoke 500 to rotate about axle 522 in the reverse direction until stopped in the first position by the stop member 516 (see FIG. 7), thus bringing pinion 504 into engagement with the intermediate gear 508. In the first position, first drive pinion 504 drives the intermediate gear 508 in the reverse direction. The intermediate gear 508, in turn, drives the first recording gear 510 in the forward direction. The forward rotation of the first recording gear 510 causes a corresponding register dial indicator (not shown) to move upscale across a dial face (not shown), thereby registering positive power consumption.

The first recording gear 510 may be interconnected to virtually any number of other recording gears to provide the desired range of registering capability. For example, in the dial register 100 illustrated in FIG. 1, five meters are utilized which allows a value of up to "99999" to be registered before the register rolls over to "00000." The interconnection and configuration of additional meters is well-known in the watthour meter art and need not be discussed further herein.

Figure 6:
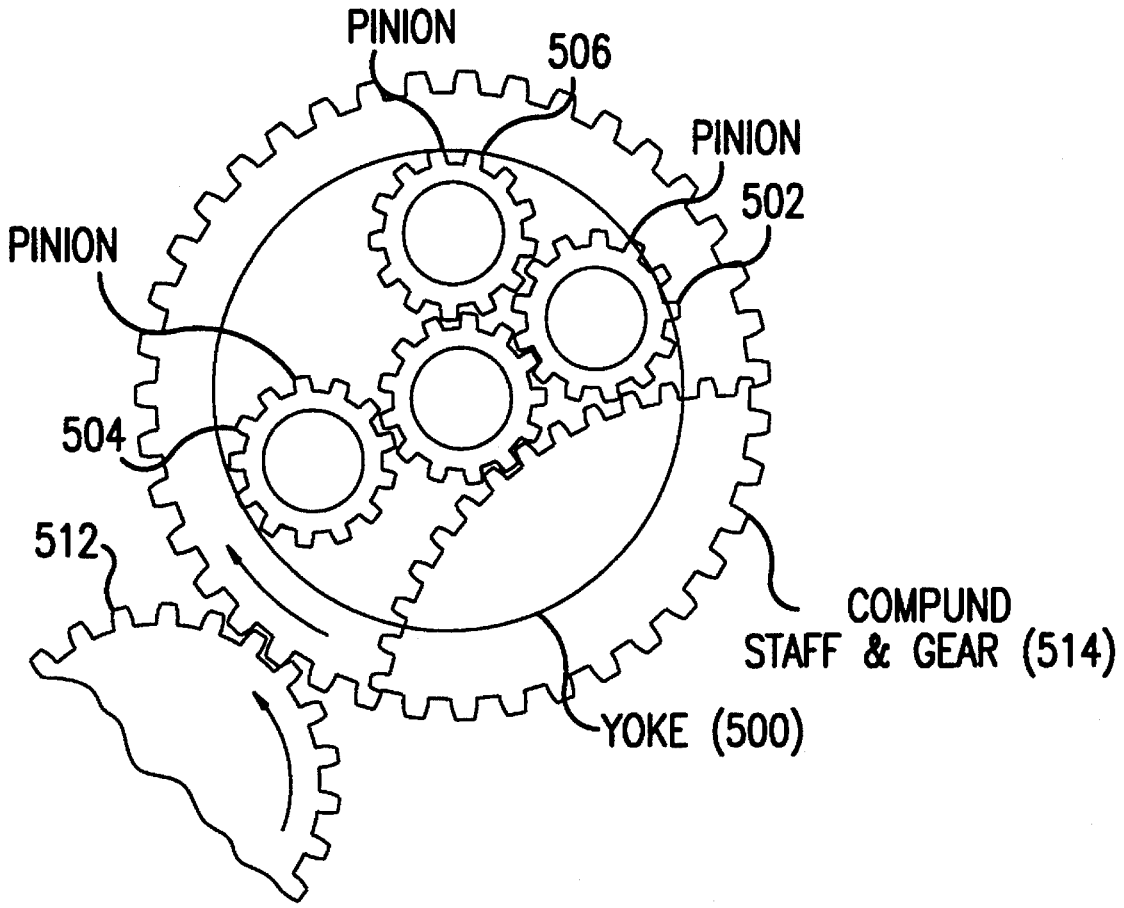
FIG. 6 is an enlarged plan view of the embodiment of the unidirectional register mechanism illustrated in FIG. 5.

As shown in FIG. 6, when the input gear 512 is driven in the reverse direction by the rotational input, the compound staff/gear 514 is caused to rotate about axle 522 in the forward direction. Due to the friction present between the compound staff/gear 514 and the yoke 500, the yoke 500 is caused to rotate about axle 522 in the forward direction until stopped in the second position by the stop member 516 (see FIG. 7), thus bringing pinion 502 into engagement with the intermediate gear 508. The forward rotation of compound staff/gear 514 causes the reversing pinion 506 to rotate in the reverse direction, thus driving the second drive pinion 502 in the forward direction. The forward rotation of the second drive pinion 502, while in the second position, drives the intermediate gear 508 in the reverse direction, thus driving the first recording gear 510 in the forward direction. As with the state of the register mechanism illustrated in FIG. 5, the forward rotation of the first recording gear 510 causes the corresponding register dial indicator (not shown) to move upscale across the dial face (not shown), thereby registering positive power consumption.

In the above-described manner, the dial register is always driven upscale regardless of which direction, forward or reverse, the input gear 512 is driven.

In each of the states shown in FIG. 5 and in FIG. 6, only a single one of the two drive pinions—the first drive pinion 504 or the second drive pinion 502—is in engagement with the intermediate gear 508.

In FIG. 5, the intermediate gear 508 engages, and is solely driven by, the first drive pinion 504. Although the second drive pinion 502 is driven (via the compound staff/gear 514 and reversing pinion 506) in the reverse direction in response to the input gear 512 being driven in the forward direction, the second drive pinion 502 is not engagement with, and has substantially no effect on the reverse rotation of, the intermediate drive gear 508.

Similarly, in FIG. 6, the intermediate gear 508 engages, and is solely driven by, the second drive pinion 502. Although the first drive pinion 504 is driven (via the compound staff/gear 514) in the reverse direction in response to the input gear 512 being driven in the reverse direction, the first drive pinion 504 is not engagement with, and has substantially no effect on the reverse rotation of, the intermediate drive gear 508.

Several advantages are provided by the unidirectional register embodiment described above and illustrated in FIGS. 5–7. For example, because the intermediate gear 508 engages only a single one of the two drive pinions 504, 502 at a time, the resistive force applied to the intermediate gear 508 remains substantially the same regardless of whether the input gear 512 is being rotated in the forward or the reverse direction. Consequently, because the resistive force is substantially the same in either state of FIG. 5 or FIG. 6, the first recording gear 510 tends to rotate upscale at a constant rate regardless of the rotational input direction. In this manner, the accuracy and reliability of the unidirectional registering device is increased.

In addition, because the gear mechanism which compensates for, and translates, the rotational input (whether forward or reverse) into a constant upscale rotation, is formed as a single, integral component (i.e., the yoke 500 with the three attached pinions 502, 504 and 506), the unidirectional register mechanism may be manufactured with reduced effort and cost.

Another advantage of the single, integral component (i.e., the yoke 500 with the three attached pinions 502, 504 and 506) structure is that the unidirectional register device may be made mode compact because a separate idler gear is not needed.

Although the invention has been described in detail, it should be understood that various changes, substitutions and alterations can be made without departing from the spirit and scope of the invention as defined by the appended claims.

What is claimed is:

1. A unidirectional register apparatus comprising:

an input gear mechanism adapted to receive a rotational input from an external source;

a yoke, operatively coupled to said input gear mechanism, and arranged to pivot between a first predetermined position and a second predetermined position in response to a change in direction of the rotational input;

a first gear mechanism, attached to said yoke, and arranged to produce a first rotational output in a same direction as a rotational input direction;

a second gear mechanism, attached to said yoke, and arranged to produce a second rotational output in a direction opposite to the rotational input direction; and an output gear mechanism, alternately engageable with each of said first and second gear mechanisms, wherein (i) said output gear mechanism engages said first gear mechanism when said yoke is in the first predetermined position, and (ii) said output gear mechanism engages said second gear mechanism when said yoke is in the second predetermined position.

2. A unidirectional register apparatus according to claim 1, wherein said first and second gear mechanisms and said yoke are formed as an integral component.

3. A unidirectional register apparatus according to claim 1, wherein the yoke and the first and second gear mechanisms convert directly between the rotational input and a single upscale direction.

4. A unidirectional register apparatus according to claim 1, wherein said output gear mechanism comprises an intermediate gear, said intermediate gear being driven only by a single drive gear.

5. A unidirectional register apparatus according to claim 1, wherein said first and second gear mechanisms pivot in concert with said yoke in response to the change in direction of the rotational input.

6. A unidirectional register apparatus according to claim 1, wherein said first gear mechanism comprises a staff gear and a pinion, said staff gear engaging said pinion, and wherein said output gear mechanism engages said pinion when said yoke is in the first predetermined position.

7. A unidirectional register apparatus according to claim 1, wherein said second gear mechanism comprises a staff gear, a reversing gear, and a pinion, said staff gear engaging said reversing gear, and said reversing gear engaging said pinion, and wherein said output gear mechanism engages said pinion when said yoke is in the second predetermined position.

8. A unidirectional register apparatus according to claim 1, further comprising a staff gear, and wherein said first gear mechanism comprises a first pinion, and said second gear mechanism comprises a reversing gear and a second pinion, wherein each of said first pinion and said reversing gear engages said staff gear, and said second pinion engages said reversing gear.

9. A unidirectional register apparatus according to claim 8, wherein said output gear mechanism engages said first pinion when said yoke is in the first predetermined position, and said output gear mechanism engages said second pinion when said yoke is in the second predetermined position.

10. A unidirectional register apparatus according to claim 8, wherein (i) each of said first pinion and said reversing gear are arranged to rotate in the same direction as the rotational input direction, (ii) each of said staff gear and said second pinion are arranged to rotate in the direction opposite to the rotational input direction, (iii) said yoke is arranged to pivot in the direction opposite to the rotational input direction, and (iv) said output gear mechanism is arranged to rotate in an upscale direction without regard to the rotational input direction.

11. A unidirectional register comprising:

a yoke, operatively coupled to a rotational input from an external source, and pivotally mounted to alternately adopt (i) a first predetermined position when the rotational input comprises forward rotation, and (ii) a second predetermined position when the rotational input comprises reverse rotation;

a first gear mechanism, attached to said yoke, and arranged to produce a first rotational output in a same direction as a rotational input direction;

a second gear mechanism, attached to said yoke, and arranged to produce a second rotational output in a direction opposite to the rotational input direction; and an output gear, alternately engageable with each of said first and second gear mechanisms, wherein (i) said output gear engages said first gear mechanism when said yoke is in the first predetermined position, and (ii) said output gear engages said second gear mechanism when said yoke is in the second predetermined position.

12. A unidirectional register according to claim 11, wherein said first and second gear mechanisms and said yoke are formed as an integral component.

13. A unidirectional register according to claim 11, wherein the yoke and the first and second gear mechanisms convert directly between the rotational input and a single upscale direction.

14. A unidirectional register according to claim 11, wherein said output gear mechanism comprises an intermediate gear, said intermediate gear being driven only by a single drive gear.

15. A unidirectional register according to claim 11, wherein said first and second gear mechanisms pivot in concert with said yoke in response to a change in direction of the rotational input.

16. A unidirectional register according to claim 11, wherein said first gear mechanism comprises a staff gear and a pinion, said staff gear engaging said pinion, and wherein said output gear engages said pinion when said yoke is in the first predetermined position.

17. A unidirectional register according to claim 11, wherein said second gear mechanism comprises a staff gear, a reversing gear, and a pinion, said staff gear engaging said reversing gear, and said reversing gear engaging said pinion, and wherein said output gear engages said pinion when said yoke is in the second predetermined position.

18. A unidirectional register according to claim 11, further comprising a staff gear, and wherein said first gear mechanism comprises a first pinion, and said second gear mechanism comprises a reversing gear and a second pinion, wherein each of said first pinion and said reversing gear engages said staff gear, and said second pinion engages said reversing gear.

19. A unidirectional register according to claim 18, wherein said output gear engages said first pinion when said yoke is in the first predetermined position, and said output gear engages said second pinion when said yoke is in the second predetermined position.

20. A unidirectional register according to claim 18, wherein (i) each of said first pinion and said reversing gear are arranged to rotate in the same direction as the rotational input direction, (ii) each of said staff gear and said second pinion are arranged to rotate in the direction opposite to the rotational input direction, and (iii) said output gear is arranged to rotate in an upscale direction without regard to the rotational input direction.

* * * * *